US010507152B2

(12) United States Patent
Afshani

(10) Patent No.: US 10,507,152 B2
(45) Date of Patent: Dec. 17, 2019

(54) ASSISTIVE DEVICE, AND METHOD OF USE

(71) Applicant: BLUE ORCHID CARE INC., Hamilton (CA)

(72) Inventor: Sina Afshani, Hamilton (CA)

(73) Assignee: Blue Orchid Care Inc., Hamilton (CA)

( * ) Notice: Subject to any disclaimer, the term of this patent is extended or adjusted under 35 U.S.C. 154(b) by 520 days.

(21) Appl. No.: 15/330,794

(22) PCT Filed: May 7, 2015

(86) PCT No.: PCT/CA2015/000298
§ 371 (c)(1),
(2) Date: Nov. 7, 2016

(87) PCT Pub. No.: WO2015/168775
PCT Pub. Date: Nov. 12, 2015

(65) Prior Publication Data

US 2017/0165139 A1 Jun. 15, 2017

Related U.S. Application Data

(60) Provisional application No. 61/989,683, filed on May 7, 2014.

(51) Int. Cl.
*A61G 7/10* (2006.01)
*A61H 3/04* (2006.01)

(52) U.S. Cl.
CPC ..... *A61G 7/1038* (2013.01); *A61G 7/1046* (2013.01); *A61H 3/04* (2013.01); *A61G 2200/34* (2013.01); *A61G 2200/36* (2013.01)

(58) Field of Classification Search
CPC ..... A61G 7/1038; A61G 7/1046; A61G 2200/34; A61G 2200/36; A61H 3/04
See application file for complete search history.

(56) References Cited

U.S. PATENT DOCUMENTS

| | | | | |
|---|---|---|---|---|
| 5,950,258 | A * | 9/1999 | Deyne | A61G 7/10 135/66 |
| 8,251,079 | B1 * | 8/2012 | Lutz | A61H 3/04 135/67 |
| 2007/0267054 | A1 * | 11/2007 | Meyers | A61H 3/04 135/67 |
| 2009/0033052 | A1 * | 2/2009 | Bradshaw | A61H 3/04 280/87.021 |
| 2012/0104711 | A1 * | 5/2012 | Alexander | A61G 5/00 280/47.34 |
| 2014/0289960 | A1 * | 10/2014 | Hjort | A61G 7/1019 5/83.1 |
| 2018/0116899 | A1 * | 5/2018 | Schaaper | A61H 3/04 |
| 2018/0228685 | A1 * | 8/2018 | Schreier | A61H 3/04 |

(Continued)

*Primary Examiner* — Eric J Kurilla
(74) *Attorney, Agent, or Firm* — Aird & McBurney LP

(57) ABSTRACT

An assistive device having: a chassis; a handle assembly pivotally attached to said chassis, said chassis comprising a handle chassis portion for receiving a handle assembly and a platform chassis portion extending from said handle chassis portion with a standing platform; a locking mechanism operable to place and lock said handle assembly into a plurality of positions; a lever mechanism coupled to said locking mechanism to actuate said locking mechanism; and wherein said plurality of positions correspond to one of a loading position, an upright position and a storage position.

20 Claims, 17 Drawing Sheets

(56) References Cited

U.S. PATENT DOCUMENTS

| | | | | |
|---|---|---|---|---|
| 2018/0242888 | A1* | 8/2018 | Schmutzer | G06F 19/3481 |
| 2018/0369032 | A1* | 12/2018 | Chang | A61G 5/1002 |
| 2019/0029915 | A1* | 1/2019 | Brockway | A61H 3/04 |
| 2019/0046389 | A1* | 2/2019 | Liang | A61H 3/04 |

* cited by examiner

ASSISTIVE DEVICE, AND METHOD OF USE

FIELD OF THE INVENTION

The present invention relates to mobility devices, more particularly it relates to assistive devices for facilitating standing from a sitting position, or vice-versa.

DESCRIPTION OF THE RELATED ART

Inaccurate or improper handling and lifting of a patient by caregivers (either professional or family member) can put both parties involved at high risk for further injuries such as falls and musculoskeletal injury. The forward bending required for many patient-lifting and moving activities places the caregiver's spine in a vulnerable position. Even under ideal lifting conditions, the weight of any adult far exceeds the lifting capacity of most caregivers, 90 percent of whom are female.

Current products on the market are bulky, cumbersome, and expensive and are not designed for a home setting. For example, hoist floor-based lifts and ceiling-based lifts which lifts the patient with a fabric sling are typically found in institutions are difficult to use, and cause increased patient anxiety and diminished patient safety.

It is an object of the present invention to mitigate or obviate at least one of the above-mentioned disadvantages.

SUMMARY OF THE INVENTION

In one of its aspects, there is provided an assistive device having:

a chassis;

a handle assembly pivotally attached to said chassis, said chassis comprising a handle chassis portion for receiving said handle assembly and a platform chassis portion extending from said handle chassis portion with a standing platform;

a locking mechanism operable to place said handle assembly into a plurality of positions, and maintain said handle assembly in one of said plurality of positions;

a lever mechanism coupled to said locking mechanism to actuate said locking mechanism; and wherein said plurality of positions correspond to one of a loading position, an upright position and a storage position.

In another of its aspects, there is provided a transfer and lifting device for moving a person from a seated position to a standing position, comprising:

a base upon which said person places their feet while in a sitting position, said base including lockable wheels wherein said wheels are locked during transfer and when unlocked they allow for wheeled movement of said device; and a curved handle assembly pivotally attached to said base, said handle assembly including a plurality of handles on an assembly that is curved away from said person so that at least one of said plurality of handles is suitable for grasping by said person with their arms fully extended and raised upward and a second handle suitable for being grasped by an aide, wherein when grasped by both said person and said aide and said aide pulls on at least one of said plurality of handles, said person is pulled from the seated position to the standing position, lifting said patient along an upward arc.

In another of its aspects, there is provided a method of transferring a patient from a seated position to a standing position, the method having the steps of:

providing an assistive device having:

a chassis;

a handle assembly pivotally attached to said chassis, said chassis comprising a handle chassis portion for receiving a handle assembly and a platform chassis portion extending from handle chassis portion with a standing platform;

a locking mechanism operable to place said handle assembly into a plurality of positions, and maintain said handle assembly in one of said plurality of positions;

a lever mechanism coupled to said locking mechanism to actuate said locking mechanism; and wherein said plurality of positions correspond to one of a loading position, an upright position and a storage position;

positioning said patient in front of said device to grasp said handle assembly while seated; and pulling said patient from said seated position to said standing position by pulling on said handle assembly to lift said patient along a predetermined upward arc.

BRIEF DESCRIPTION OF THE DRAWINGS

Several exemplary embodiments of the present invention will now be described, by way of example only, with reference to the appended drawings in which.

DETAILED DESCRIPTION OF EXEMPLARY EMBODIMENTS

The detailed description of exemplary embodiments of the invention herein makes reference to the accompanying block diagrams and schematic diagrams, which show the exemplary embodiment by way of illustration. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented.

Moreover, it should be appreciated that the particular implementations shown and described herein are illustrative of the invention and its best mode and are not intended to otherwise limit the scope of the present invention in any way. Indeed, for the sake of brevity, certain sub-components of the individual operating components and other functional aspects of the systems may not be described in detail herein. Furthermore, the connecting lines shown in the various figures contained herein are intended to represent exemplary functional relationships and/or physical couplings between the various elements. It should be noted that many alternative or additional functional relationships or physical connections may be present in a practical system.

Figure 1:
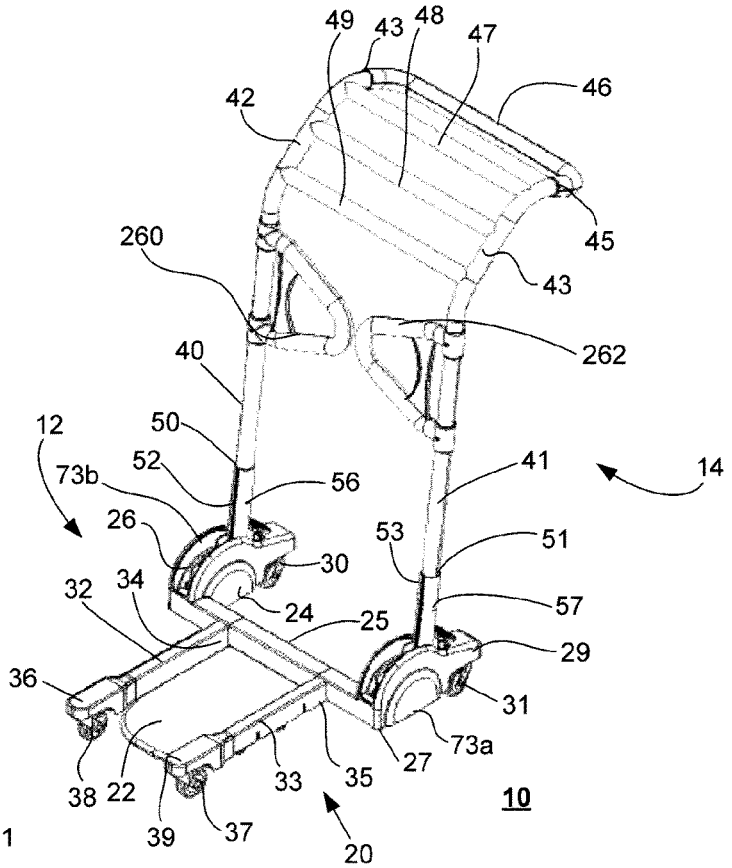
FIG. 1 shows a perspective view of an assistive device, in one exemplary embodiment.

FIG. 1 shows a perspective view of an assistive device, generally designated by the numeral 10, comprising chassis 12 and handle assembly 14 pivotally attached thereto. Chassis 16 comprises handle chassis portion 18 for receiving handle assembly 14 and platform chassis portion 20 extending therefrom. Platform chassis portion 20 includes a base or platform 22 on which a patient stands on. Handle chassis portion 18 comprises a pair of oppositely disposed tubular members 23, 24 having a rectangular cross-section, and linked to each other at ends 26, 27 of tubular members 23, 24, respectively, by a crossbar tubular member 25, such that each of tubular members 23, 24 is perpendicularly disposed to crossbar tubular member 25. Other ends 28, 29 of tubular members 23, 24 include castor wheels 30, 31, respectively. Platform chassis portion 20 is formed of two oppositely disposed tubular members 32, 33, extending perpendicularly from crossbar tubular member 25 at one end 34, 35, adjacent to ends 26, 27. Platform 22 is secured between two tubular members 32, 33 and crossbar tubular member 25. Other ends 36, 37 of two tubular members 32, 33 include castor wheels 38, 39, respectively, such that, along with castor wheels 30, 31, wheeled motion of the device 10, with or without a patient standing on platform 22, is permitted.

Figure 2:
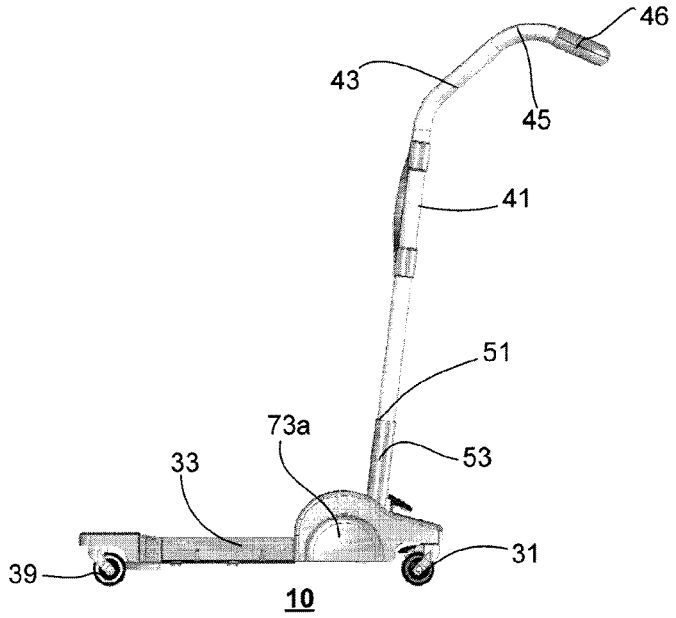
FIG. 2 shows a side view of the assistive device.
Figure 3A:
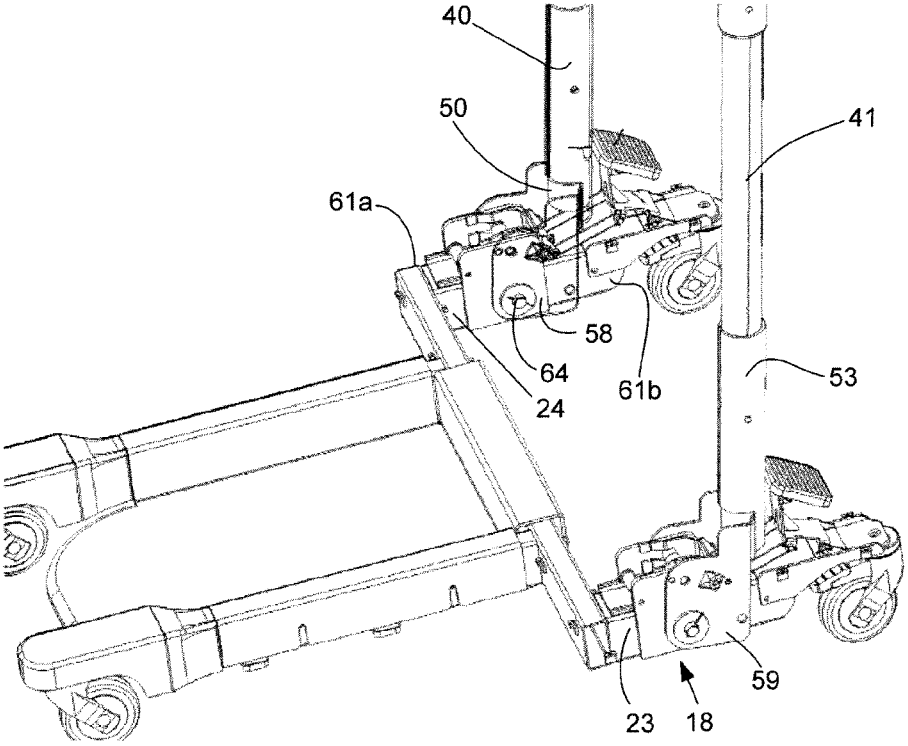
FIG. 3*a* shows a view of a chassis.

Handle assembly 14 includes a pair of oppositely disposed, elongated tubular members 40, 41, each having an arcuate segment 42, 43 with ends 44, 45, respectively, as can be seen in FIG. 2. Secured between ends 44, 45 is transverse tubular primary handlebar grip 46. Additional secondary handlebar grips 47, 48, 49, are secured between arcuate segments 42 and 43. The primary handlebar grip 46 is preferably situated at a height that is comfortable and ergonomically correct for an operator, such as a caregiver, when the operator is in a standing position, as will be described later with reference to FIGS. 11*a* to 11*c*. Also, the positioning of secondary handlebar grips 47, 48, 49 above chassis 12, and spacing therebetween, is chosen to be facilitate grasping by patients of various sizes, and varying reach. Ends 50, 51 of elongated tubular members 40, 41 are received by tubular bodies 52, 53 that have annular bores 54, 55 (not shown) that are complementary to the tubular bodies 52, 53 to enable the tubular bodies 52, 53 to slide thereinto; and secured therein via retaining mechanism 56, 57. Tubular bodies 52, 53 are integrally formed with handle bracket 58, 59, pivotally attached to handle chassis portion 18, as is best illustrated in FIG. 3*a*.

Figure 3B:
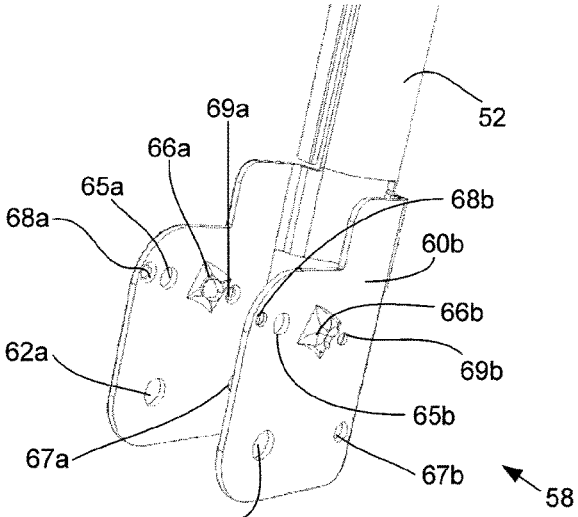
FIG. 3*b* shows a view of a mounting bracket.

FIG. 3*b* shows a perspective view of handle bracket 58, comprising oppositely disposed side plates 60*a*, 60*b*, formed with tubular body 52. Side plates 60*a*, 60*b* are substantially rectangular, and are disposed on opposite side walls 61*a*, 61*b* of tubular member 24 of handle chassis portion 18. Shaft holes 62*a*, 62*b* within side plates 60*a*, 60*b* and complementary shaft holes 63*a*, 63*b* (not shown) in opposite side walls 61*a*, 61*b* of tubular member 24, receive shaft pin 64 to allow pivotal movement about tubular member 24 of handle chassis portion 18. Accordingly, handle assembly 14 may be placed in a plurality of operating modes, such as a loading position, upright position and storage position. Therefore, a force applied to handle assembly 14 causes handle bracket 58 to rotate and lock the device 10 in one of these positions. Accordingly, side plates 60*a*, 60*b*, include a loading position chamfered aperture 66*a*, 66*b*, upright position aperture 65*a*, 65*b* and storage position aperture 67*a*, 67*b*. Side plates 60*a*, 60*b* also include loading lock position aperture 68*a*, 68*b* and storage lock position aperture 69*a*, 69*b*.

As shown in FIGS. 4*a*, 4*b*, 4*c*, 4*d* and 4*e*, the operating modes are controlled by a locking mechanism 70 comprising pedal 72 coupled to lever mechanism 74 which acts on carriage slider 76 held by slider holder 75 to cause spring-loaded mode pin 78 to engage or disengage the appropriate position apertures 65*a*, 65*b*, 66*a*, 66*b*, and 67*a*, 67*b*, and spring-loaded locking pin 80 to engage or disengage the appropriate position apertures 68*a*, 68*b* and 69*a*, 69*b*. Cover 73 is attached to handle chassis portion 18 and partially conceals locking mechanism 70, and lever mechanism 74. Handle bracket 59 comprises identical parts, and therefore the description of handle bracket 58, locking mechanism 70 and lever mechanism 74 herein applies to handle bracket 59 and associated locking mechanism 77 (not shown) and lever mechanism 79 (not shown).

Figure 4A:
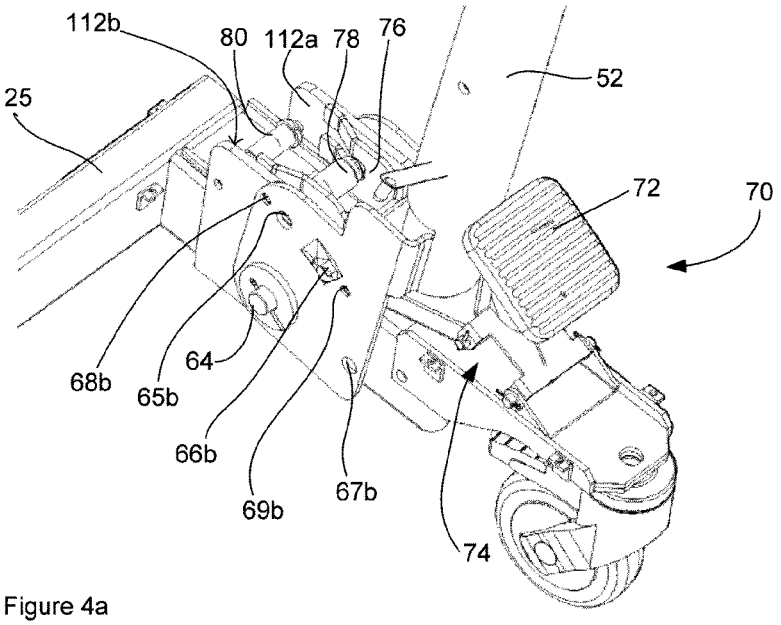
FIGS. 4*a* to 4*f* show various views of a lever mechanism and locking mechanism.
Figure 4B:
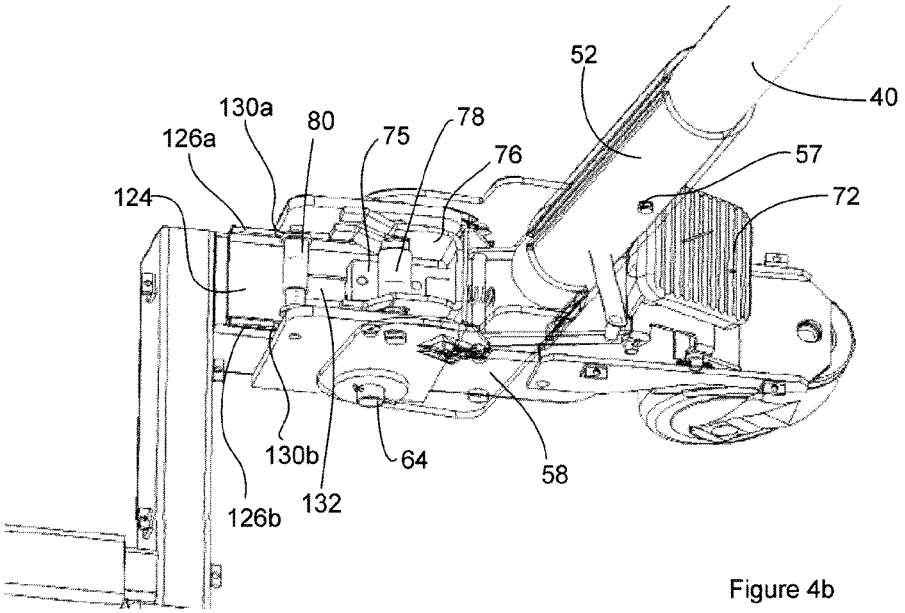
Figure 4C:
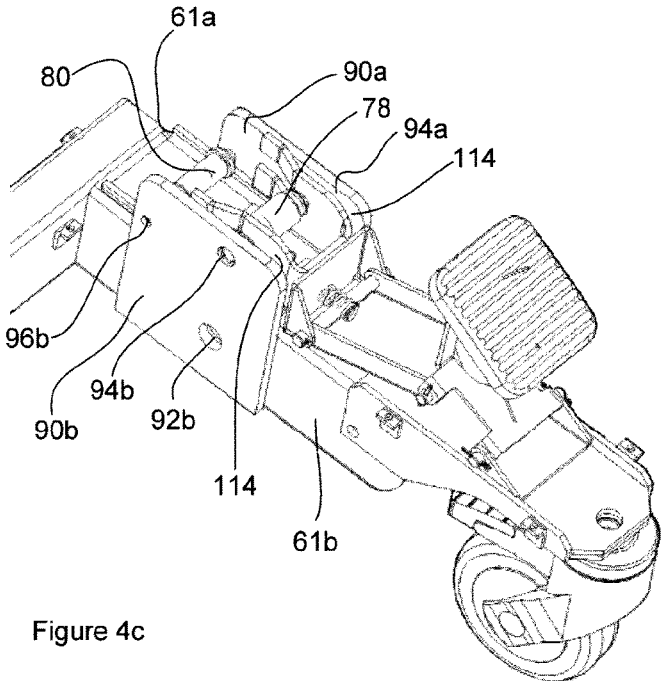

As shown in FIG. 4*c*, chassis brackets 90*a*, 90*b* are affixed to opposite side walls 61*a*, 61*b* of tubular member 24 of handle chassis portion 18, and sandwiched by side plates 60*a*, 60*b* and opposite side walls 61*a*, 61*b*. Chassis brackets 90*a*, 90*b* are substantially rectangular, and include bracket shaft holes 92*a*, 92*b* aligned with shaft holes 63*a*, 63*b*, and also receive shaft pin 64; large pin holes 94*a*, 94*b* which receive pin heads of spring-loaded mode pin 78, and small pin holes 96*a*, 96*b* which receive pin heads of spring-loaded locking pin 80, as will be described in greater detail below.

Figure 4D:
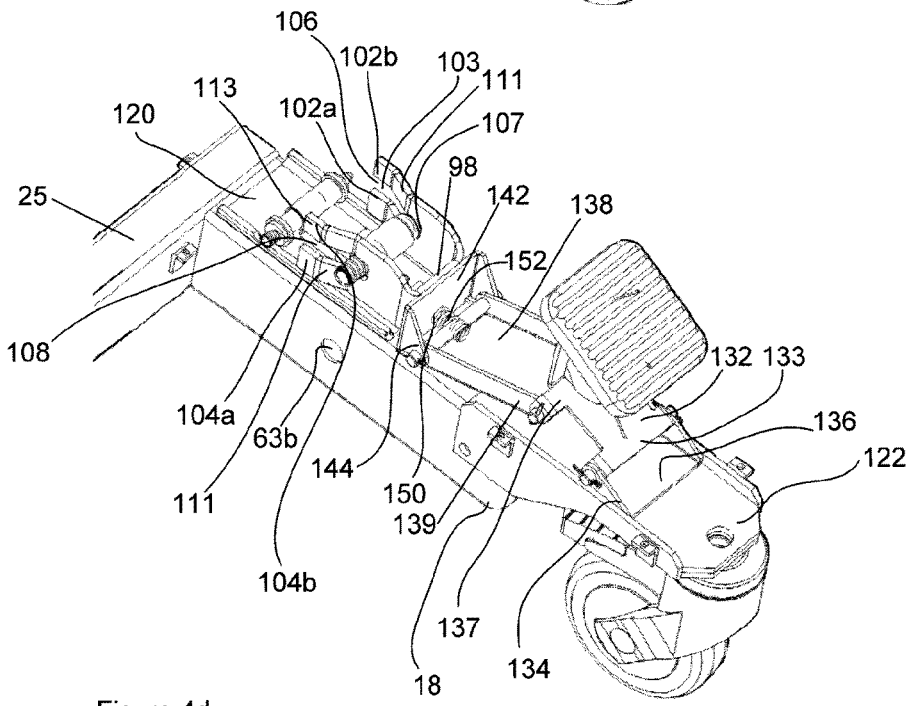

Carriage slider 76 includes back portion 98 orthogonally disposed to a pair of opposed plates 100*a*, 100*b* with finger portions 102*a*, 102*b* which define a longitudinal slot 103, and finger portions 104*a*, 104*b* which define a longitudinal slot 105, respectively, as shown in FIG. 4*d*. Longitudinal slot 103 comprises open end 106 and closed end 107, longitudinal slot 105 comprises open end 108 and closed end 109. Each finger portion 102*a*, 102*b*, 104*a*, 104*b* comprises proximal portion 110 formed with opposed plates 100*a*, 100*b*, middle portion 111 angled away from plates 100*a*, 100*b* towards inner walls 112*a*, 112*b* of chassis brackets 90*a*, 90*b*, and distal portion 113 disposed in close proximity with inner walls 112*a*,112*b*. Opposed plates 100*a*, 100*b* and proximal portion 110 of finger portions 104*a*, 104*b* are disposed away from inner walls 112*a*, 112*b*, such that gap 114 is defined therebetween. As the device 10 is configured in the different operating modes, spring-loaded mode pin 78 remains resiliently biased within longitudinal slots 103, 105, while its pin heads engage or disengage large pin holes 94*a*, 94*b*

Carriage slider 76 is caused to slide back and forth, with carriage guide tray 120 sliding on top wall 122 of tubular member 24 of handle chassis portion 18. Guide tray 120 comprises an elongate, planar body 124 with one end 126 adjacent to crossbar tubular member 25, and opposite end 127 (not shown) adjacent to lever mechanism 74. Elongate, planar body 124 includes opposed longitudinal lips 128*a*, 128*b* along its length extending between ends 126 and 127. Each of opposed lips 128*a*, 128*b* include a semi-circular groove 130*a*, 130*b* disposed on the edge of lip 128*a*, 128*b*, which is engageable by spring-loaded locking pin 80 as the device 10 is configured in the different operating modes. Elongate, planar body 124 also includes a hollowed-out channel 132 which is engaged by slider holder 75 to limit the sliding motion of the carriage slider 76 when a force is applied to carriage slider 76 via lever mechanism 74.

Figure 4E:
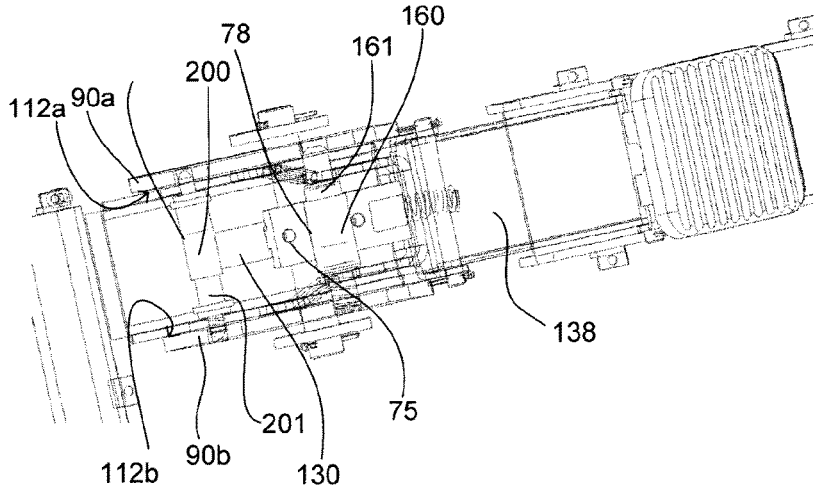

As can be seen in FIGS. 4*d* and 4*e*, lever mechanism 74 comprises pedal 72 joined to a mounting plate 132 having one end 133 pivotally attached to a mounting bracket 134 resting on top wall 122 of tubular member 24 of handle chassis portion 18. A resilient member, such as spring 136, is place between top wall 122 and mounting plate 132 to force the mounting plate 132 into an angled position in relation to the top wall 122. Other end 137 of mounting plate 132 is hingedly coupled to elongate actuating lever 138 at one end 139, and other end 140 is pivotally attached to actuating member 142 abutting back portion 98 of carriage slider 76. End 140 is pivotally attached to a bottom section 144 of actuating member 142 via pivoting shaft 143, such that actuating lever 138 is disposed in an angled position with top wall 122. Accordingly, applying a force to pedal 72 causes end 137 of mounting plate 132 to advance towards top wall 122, increasing the tension in spring 136, and end 139 of actuating lever 138 also advances towards top wall 122 in sympathy. As end 139 of actuating lever 138 advances towards top wall 122, end 140 pushes against actuating member 142 abutting back portion 98 of carriage slider 76, to cause carriage slider 76 to move along carriage guide tray 120, to configure the device 10 in one of the operating modes. A force may be applied to pedal 72 to unlock the locking mechanism 70, and the actuating lever 138, mounting plate 132, and spring 136, are returned to their natural state.

Adjacent to bottom section 144 of actuating member 142 is orifice 150 which receives a resilient member, such as holder spring 152 extending therethrough and orifice 154 of back portion 98. Resilient member 152 is attached to pivoting shaft 143 and slider holder 75 to facilitate smooth motion of carriage slider 76, and hence smooth transitions between operating modes.

Figure 4F:
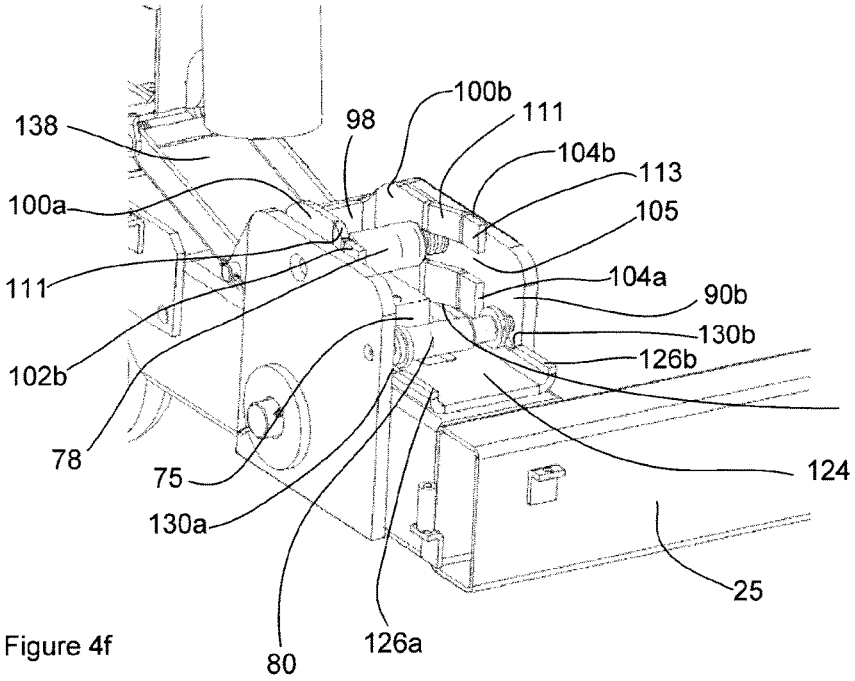
Figure 5A:
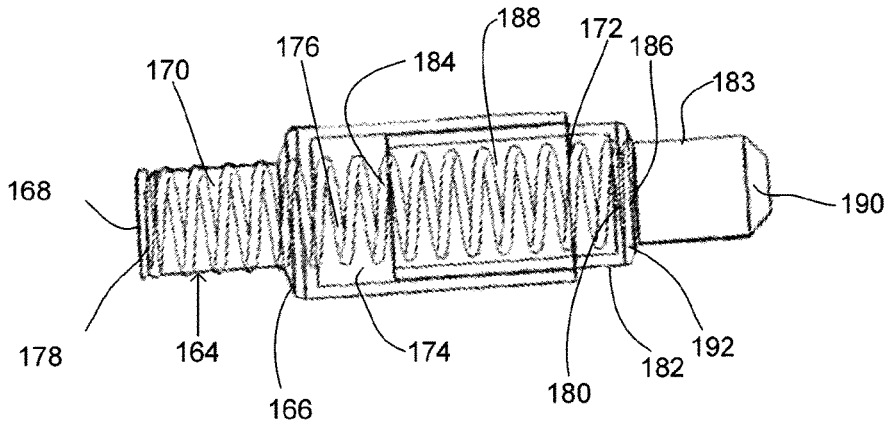
FIG. 5*a* shows a cut-out view of a mode pin.

Looking at FIGS. 4*e* and 4*f*, spring-loaded mode pin 78 is resiliently biased to remain within slots 103 and 105, and comprises outer tubular sleeve 160 and inner tubular sleeve 161 slidable therein. Outer tubular sleeve 160 includes upper sleeve portion 162 and lower sleeve portion 164, as can be seen in FIG. 5*a*. Lower sleeve portion 164 has a smaller diameter compared to the diameter of upper sleeve portion 162, such that outer circumferential shoulder 166 is defined therebetween. Lower sleeve portion 164 terminates at frustoconical head 168, and includes lower passageway 170 with a circular cross-section extending between frustoconical head 168 and shoulder 166. Upper sleeve portion 162 comprises open end 172 and includes upper passageway 174 with a circular cross-section extending from open end 172 and shoulder 166. A resilient means, such as helical spring 176 is received by lower passageway 170 and upper passageway 174, such that one end 178 abuts head 168 and another end 180 of helical spring 176 extends beyond open end 172.

Inner tubular sleeve 161 includes tubular sleeve portion 182 and shank 183. Tubular sleeve portion 182 includes open end 184 and closed end 186 and passageway 188 defined therebetween. Shank 183 with frustoconical shank head 190 extends from closed end 186. Shank 183 has a smaller diameter compared to the diameter of tubular sleeve portion 182, such that inner circumferential shoulder 192 is defined therebetween.

Inner tubular sleeve 161 is slidably introduced into upper passageway 174, such that end 179 of helical spring 176 abuts closed end 186 of tubular sleeve portion 182. Accordingly, when a force is applied to shank head 190 and frustoconical head 168 open end 184 of tubular sleeve portion 182 advances towards outer circumferential shoulder 166, while open end 172 of upper sleeve portion 162 advances towards closed end 186 of tubular sleeve portion 182, thus compressing the helical spring 176 such that the overall length of spring-loaded mode pin 78 is reduced. Removal of the force cause the helical spring 176 to decompress, thereby forcing open end 184 of tubular sleeve portion 182 to retreat from outer circumferential shoulder 166, and causing open end 172 of upper sleeve portion 162 to retreat from closed end 186 of tubular sleeve portion 182.

Figure 5B:
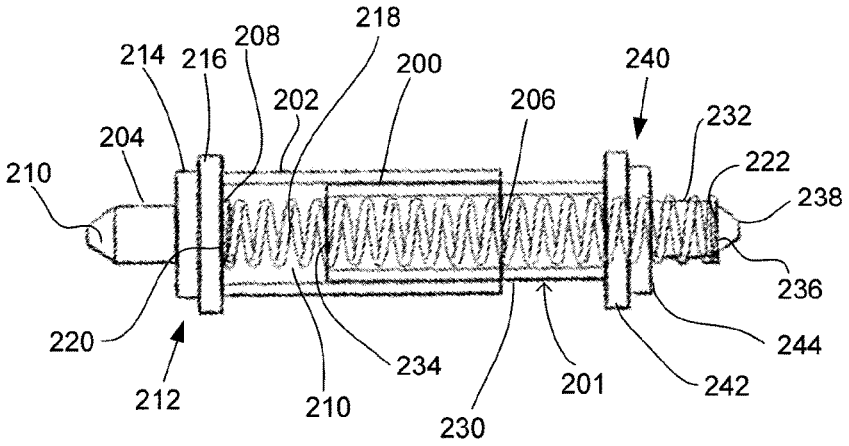
FIG. 5*b* shows a cut-out view of a locking pin.

Looking at FIGS. 4*c*, 4*e* and 4*f*, spring-loaded locking pin 80 is resiliently biased between inner walls 112*a*, 112*b* of chassis brackets 90*a*, 90*b*. As shown in FIG. 5*b*, spring-loaded locking pin 80 comprises outer tubular sleeve 200 and inner tubular sleeve 201 slidable therein. Outer tubular sleeve 200 includes tubular sleeve portion 202 and shank 204. Tubular sleeve portion 202 includes open end 206 and closed end 208 and passageway 210 defined therebetween. Shank 204 with frustoconical shank head 210 extends from closed end 208. Shank 204 has a smaller diameter compared to the diameter of tubular sleeve portion 202, and includes a graduated flange 212 with first annular flange 214 and second annular flange 216 adjacent to closed end 208. Second annular flange 216 has a diameter greater than the diameter of tubular sleeve portion 202, and greater than the diameter of first annular flange 214. A resilient means, such as helical spring 218 is received by circular passageway 210, such that one end 220 abuts closed end 208, and another end 222 of helical spring 218 extends beyond open end 206 of tubular sleeve portion 202.

Inner tubular sleeve 201 is slidably introduced into circular passageway 210. Inner tubular sleeve 201 includes upper sleeve portion 230 and lower sleeve portion 232, as can be seen in FIG. 5*b*. Upper tubular sleeve portion 230 includes open end 234, and lower sleeve portion 232 includes closed end 236 with frustoconical head 238. Circular passageway 238 is defined between open end 234 and closed end 236. Lower sleeve portion 232 has a smaller diameter compared to the diameter of upper sleeve portion 230, and graduated flange 240 is formed adjacent closed end 236. Graduated flange 212 with first annular flange 242 and second annular flange 244 is disposed adjacent to closed end 36. Second annular flange 244 has a diameter greater than the diameter of upper tubular sleeve portion 230, and greater than the diameter of first annular flange 242.

When inner tubular sleeve 201 is slidably introduced into circular passageway 210, end 222 of helical spring 218 abuts closed end 236 of lower sleeve portion 232. Accordingly, when a force is applied to shank head 210 and frustoconical head 238, open end 206 of tubular sleeve portion 202 advances towards graduated flange 240, while open end 234 of upper tubular sleeve portion 230 advances towards graduated flange 212, thus compressing the helical spring 218 such that the overall length of spring-loaded locking pin 80 is reduced. Removal of the force cause the helical spring 218 to decompress, thereby forcing open end 206 to retreat from graduated flange 240, and causing open end 234 to retreat from graduated flange 240.

The operation of the device 10 between the various operating modes will now be explained with the aid of FIGS. 4*a*, 4*b*, 6*a*, 6*b*, 7, 8, 9 and 10.

Figure 6A:
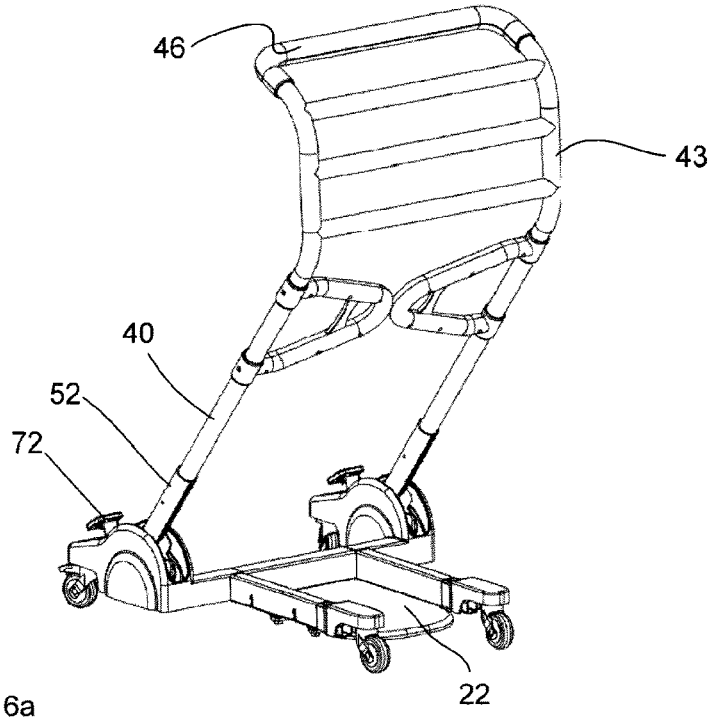
FIGS. 6*a* and 6*b* show a handle assembly in a loading position.
Figure 6B:
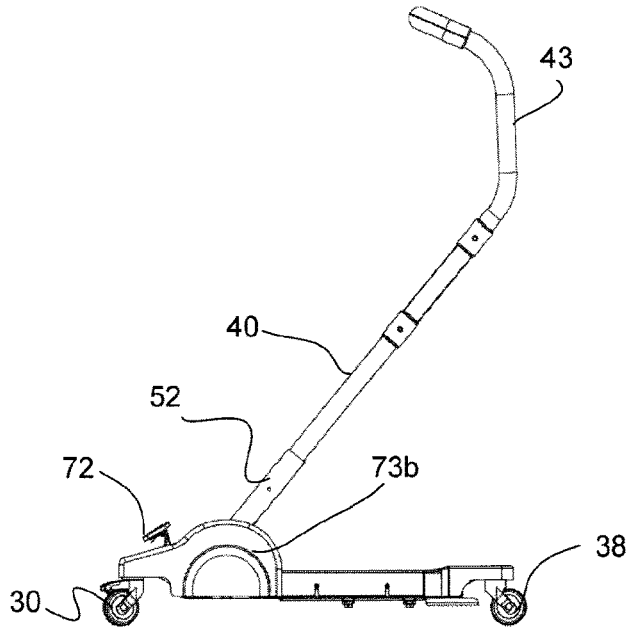
Figure 7:
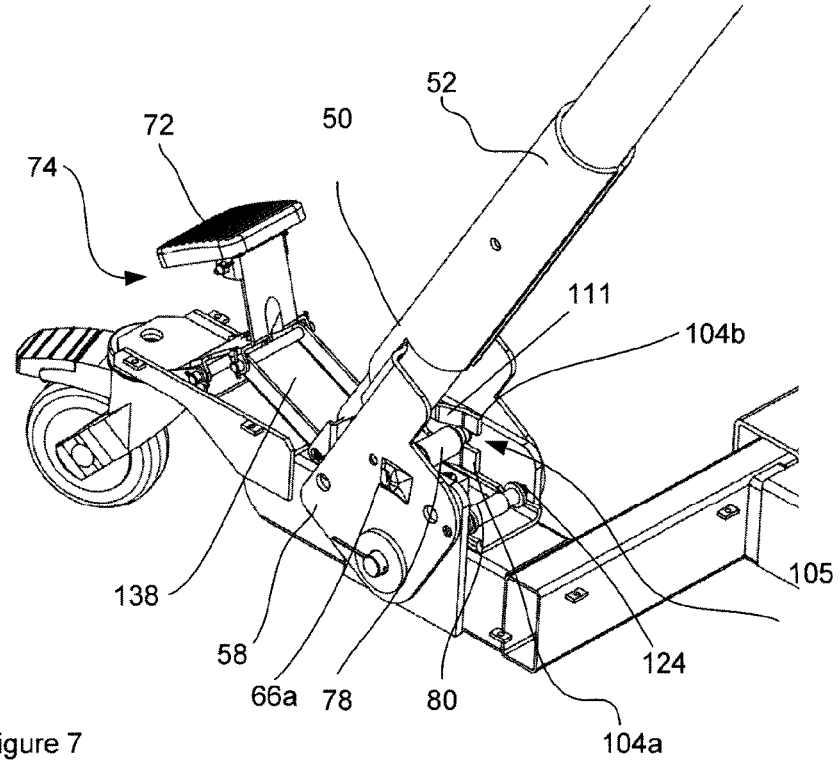
FIG. 7 shows the lever mechanism and the locking mechanism when the handle assembly is in a loading position.

FIGS. 6*a*, 6*a*, and 7 show positioning of handle assembly 14 in a loading position. In the loading position, with cover 73*b* of the locking mechanism and lever mechanism in FIG. 6 removed, FIG. 7 shows a spring-loaded mode pin 78 resiliently biased within longitudinal slots 103, 105, and spring-loaded lock pin 80 is disposed about midway of longitudinal slot 103 and longitudinal slot 105, and within middle portion 111 of finger portions 102*a*, 102*b*, 104*a*, 104*b*. Tubular sleeve portion 182 is received within large pin hole 94*b* of chassis bracket 90*a*, and head 168 is received in loading position chamfered aperture 66*b* of side plate 60*b*; and shank 190 is received within large pin hole 94*a* of chassis bracket 90*a*, and frustoconical shank head 190 is received in loading position chamfered aperture 66*a* of side plate 60*a*, as can be seen in FIG. 4*e*. The structure of chamfered apertures 66*a*, 66*b* allows free rotation of handle bracket 58 towards the operator, and inhibits rotation in the direction towards the patient.

Graduated flange 212 of spring-loaded locking pin 80 engages semi-circular groove 130*a* disposed on the edge of lip 128*a*, while graduated flange 240 engages semi-circular groove 130*b* disposed on the edge of lip 128*b*. Small pin hole 96*a* of chassis bracket 90*a* receives a portion of shank 204 and frustoconical shank head 210 of spring-loaded locking pin 80, small pin hole 96*b* of chassis bracket 90*b* receives a portion of lower sleeve portion 232 and frustoconical head 238. In this position, spring-loaded locking pin 80 maintains carriage slider 76 locked in place so that the carriage slider 76 is impeded from moving backwards due to the tension of the holder spring 152 between carriage slider 76 and slider holder 75. Advantageously, a force is not required to be applied to pedal 72 when rotating handle bracket 58, and hence handle assembly 14, otherwise a force would need to be simultaneously applied to both pedals 72 to effect rotation.

In the loading position handle assembly 14 makes an angle α with chassis 20. Therefore, a patient is able to grab primary handlebar grip 46, or secondary handlebar grips or rungs 47, 48, 49 from a sitting position and an operator is able to apply a force on handle assembly 14 away from the patient to lift the patient from a sitting position without needing to release the handle assembly 14. Once the patient's hands are securely gripping primary handlebar grip 46, or secondary handlebar grips 47, 48, 49, the operator can now transform the device 10 from a loading mode to an upright mode in which the patient is standing. From the locked loading mode, pedal 72 is pressed to apply a force to carriage slider 76 in order to unlock handle bracket 58 from the chassis bracket 90*a*. As shown in FIG. 8, lever mechanism 74 transfers the force to cause actuating member 142 to push carriage slider 76 towards crossbar tubular member 25. Simultaneously, middle portion 111 of finger portions 102*a*, 102*b*, 104*a*, 104*b* gradually moves away from outer circumferential shoulder 166 towards proximal portion 110 of finger portions 102*a*, 102*b*, 104*a*, 104*b*. By virtue of the separation between proximal portions 110 being less than the variable separation between middle portions 110, proximal portions 110 pinch spring-loaded lock pin 80 inwards to disengage shank 183 and frustoconical shank head 190 from loading position chamfered apertures 66*a* of side plate 60*a* of handle bracket 58, and to disengage lower sleeve portion 162 and frustoconical head 168 from loading position chamfered apertures 66*b* of side plate 60*b* of handle bracket 59.

Therefore, handle brackets 58, 59 are able to rotate, and carriage guide tray 120 slides from under spring-loaded locking pin 80 and graduated flange 212 disengages semi-circular groove 130*a* disposed on the edge of lip 128*a*, while graduated flange 240 disengages semi-circular groove 130*b* disposed on the edge of lip 128*b*, thereby releasing carriage slider 76, which moves back towards actuating member 142 due to the tension in holder spring 152 between carriage slider 76 and slider holder 75, as shown in FIGS. 4*a* and 4*d*.

Handle brackets 58, 59 are able to rotate until shank 183 and frustoconical shank head 190 engage upright position aperture 65*a* of side plate 60*a* of handle bracket 58, and lower sleeve portion 162 and frustoconical head 168 engage upright position aperture 65*b* of side plate 60*b* of handle bracket 59, to lock handle brackets 58, 59 to chassis brackets 90*a*, 90*b*.

Figure 8A:
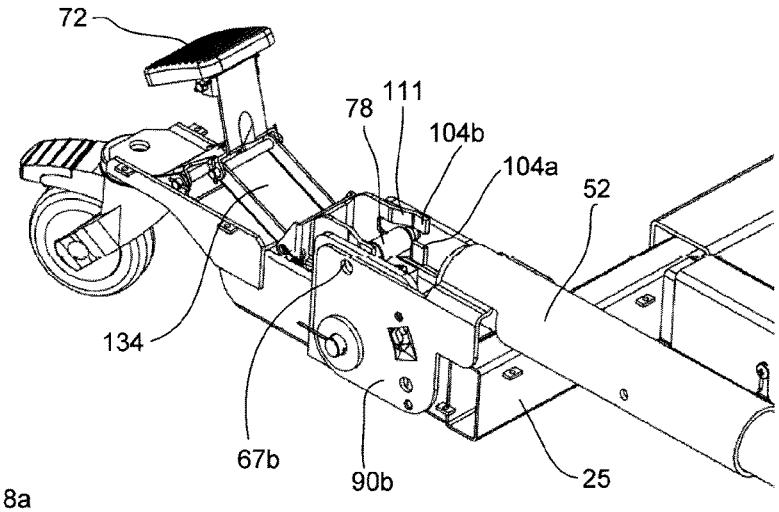
FIGS. 8*a*, 8*b* and 8*c* show views of the handle assembly in a storage mode.
Figure 8B:
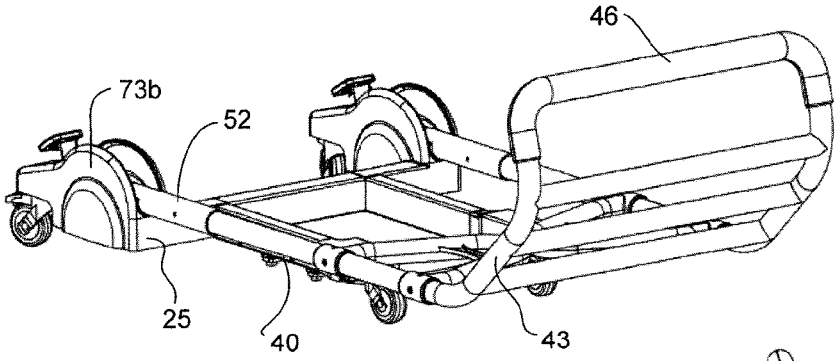
Figure 8C:
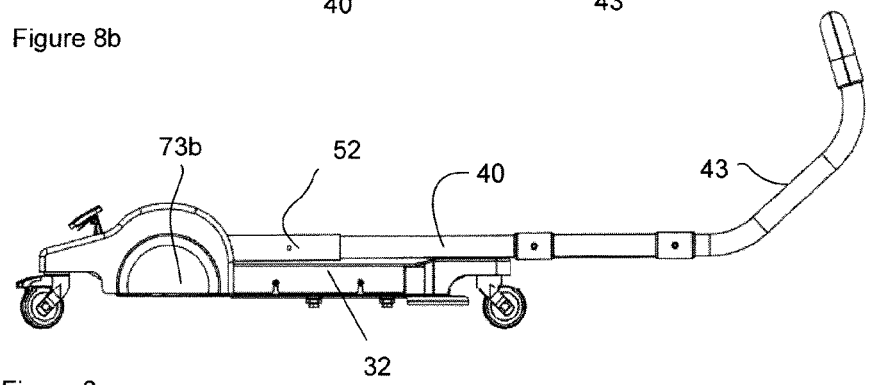

FIGS. 8*a*, 8*b* and 8*c* show device 10 being configured into a storage or transport mode. While in the loading mode, pedal 72 is pressed and handle brackets 58, 59 are released from chassis brackets 90*a*, 90*b*. Accordingly, lever mechanism 74 transfers the force from pedal 72 to cause actuating member 142 to push carriage slider 76 towards crossbar tubular member 25. Simultaneously, middle portion 111 of finger portions 102*a*, 102*b*, 104*a*, 104*b* gradually moves away from outer circumferential shoulder 166 towards proximal portion 110 of finger portions 102*a*, 102*b*, 104*a*, 104*b*. By virtue of the separation between proximal portions 110 being less than the variable separation between middle portions 110, proximal portions 110 pinch spring-loaded m mode pin 78 inwards to disengage shank 183 and frustoconical shank head 190 from loading position chamfered apertures 66*a* of side plate 60*a* of handle bracket 58, and to disengage lower sleeve portion 162 and frustoconical head 168 from loading position chamfered apertures 66*b* of side plate 60*b* of handle bracket 59. Handle assembly 14 is pushed towards platform chassis portion 20 until shank 183 and frustoconical shank head 190 engage storage position aperture 67*a* of side plate 60*a* of handle bracket 58, and lower sleeve portion 162 and frustoconical head 168 engage storage position aperture 67*b* of side plate 60*b* of handle bracket 59, to lock handle brackets 58, 59 to chassis brackets 90*a*, 90*b*.

Figure 9A:
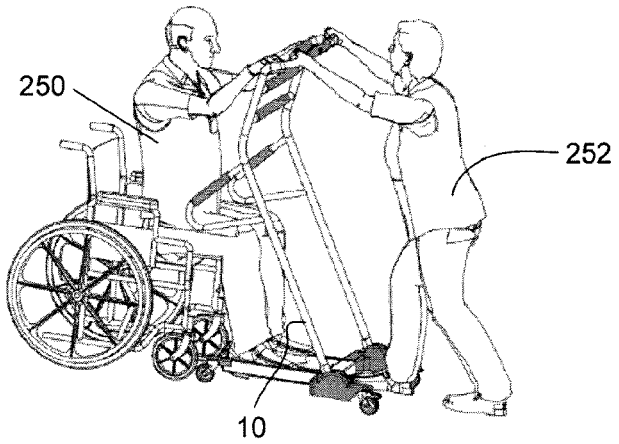
FIGS. 9*a* to 9*c* show the assistive device in use for transferring a patient from an initial sitting position to a standing position.
Figure 9B:
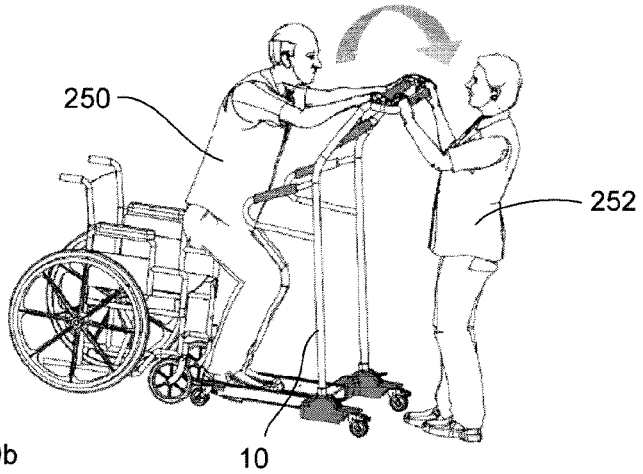
Figure 9C:
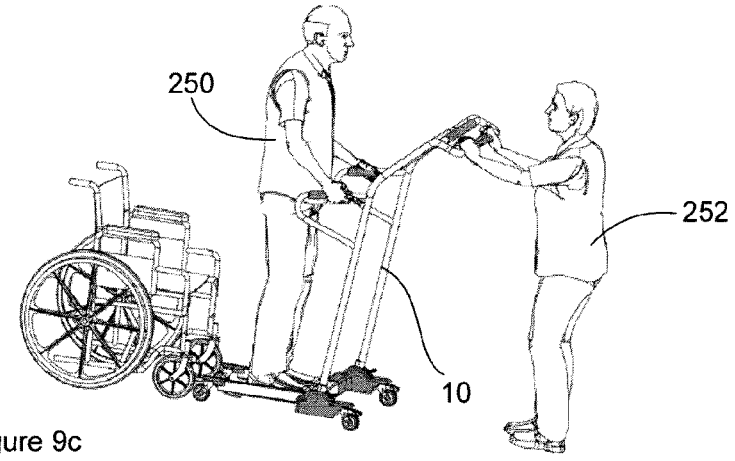

FIG. 9*a* shows assistive device 10 in operation in a loading mode of patient 250 in an initial sitting position by operator 252, in one example. Once an assessment of ability of patient 250 with respect to grip strength and stability has been made, operator 252 locks the castor wheels 30, 31 and requests patient 250 to hold on to one of secondary handle grips 47,48 and 49. Operator 252 then disengages locking mechanism to allow rotation of handle brackets 58, 59, and hence handle assembly 14. Next, operator 252 informs patient 250 of the intent to lift and transfer patient 250. With patient 250 securely gripping one of secondary handle grips 47, 48, 49, operator 252 then grasps primary handle grip 46 and pulls handle assembly 14 away from patient 250, as shown in FIG. 9*b*. Operator 250 continues pulling on handle assembly 14 in a clockwise direction, and handle brackets 58, 59 rotate until mode pin 80 engages upright position aperture 66*b* to place handle assembly 14 in an upright position, as shown in FIG. 9*c*.

Figure 10A:
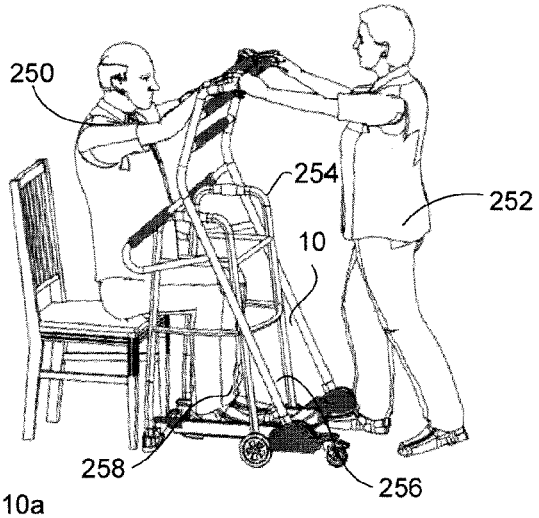
FIGS. 10*a* to 10*c* show the assistive device in use for transferring a patient from an initial standing position to a walker.
Figure 10B:
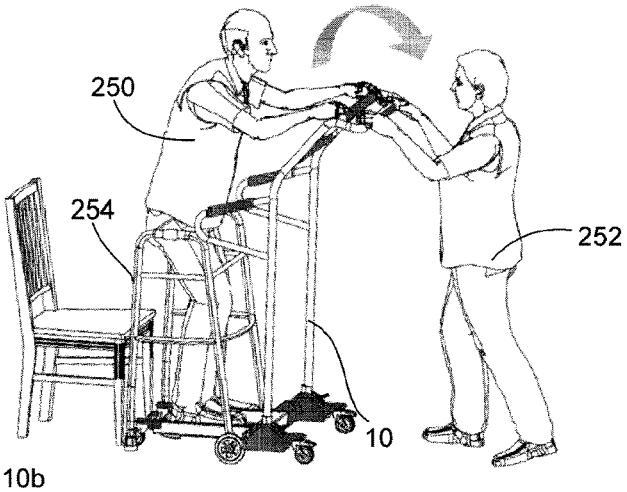
Figure 10C:
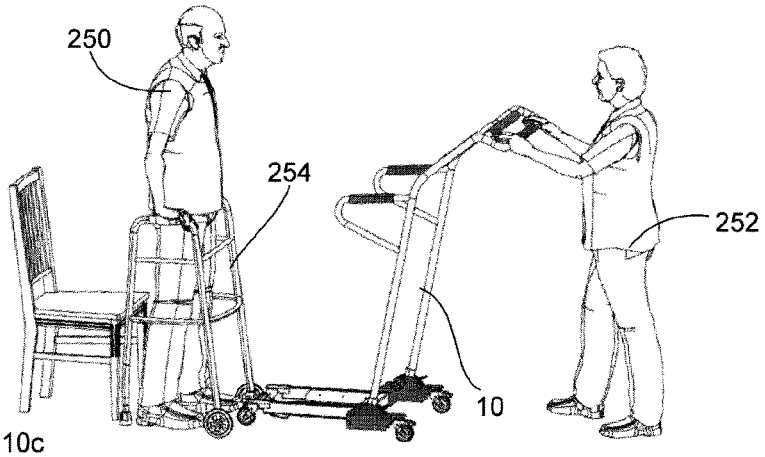

FIGS. 10*a* to 10*c* show the assistive device 10 in operation in a loading mode of patient 250 in an initial sitting position by operator 252, for direct transfer to walker 254, in one example. Looking at FIG. 10*a*, with sitted patient 250, walker 254 is placed in front of patient 250, and device 10 is rolled such that platform chassis portion 20 is disposed within opposed frame members 256, 258 of frame of walker 254. Patient 250 securely grasps one of secondary handle grips 47, 48, 49, and operator 252 then grasps primary handle grip 46 and pulls handle assembly 14 away from patient 250, as shown in FIG. 10*b*. Once lifted, patient 250 can grab on to their own walker 254 to support their body.

Figure 11A:
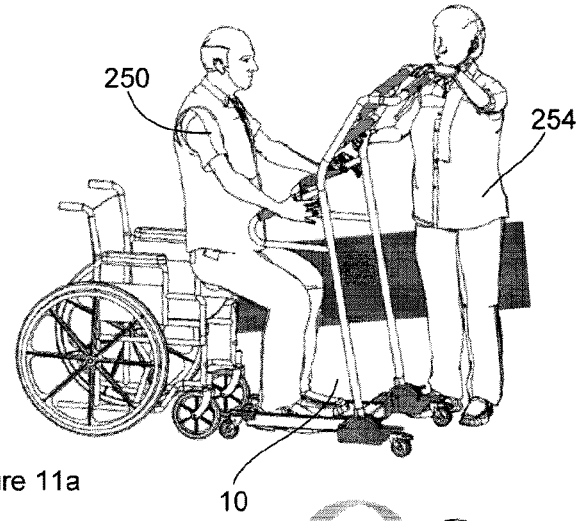
FIGS. 11*a* to 11*c* show the assistive device in use for transferring a patient from an initial standing position to a sitting position.
Figure 11B:
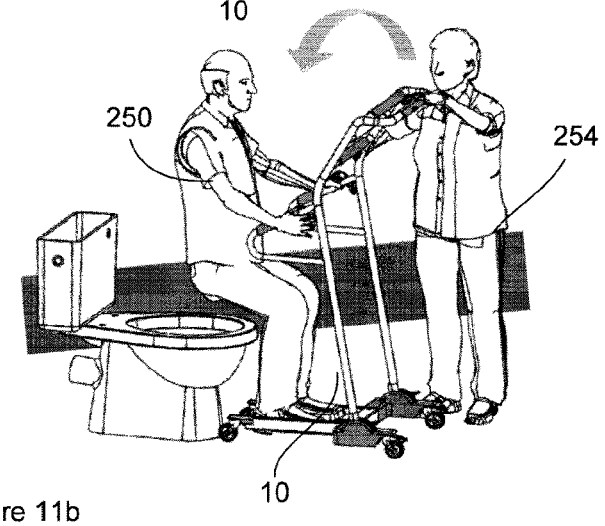
Figure 11C:
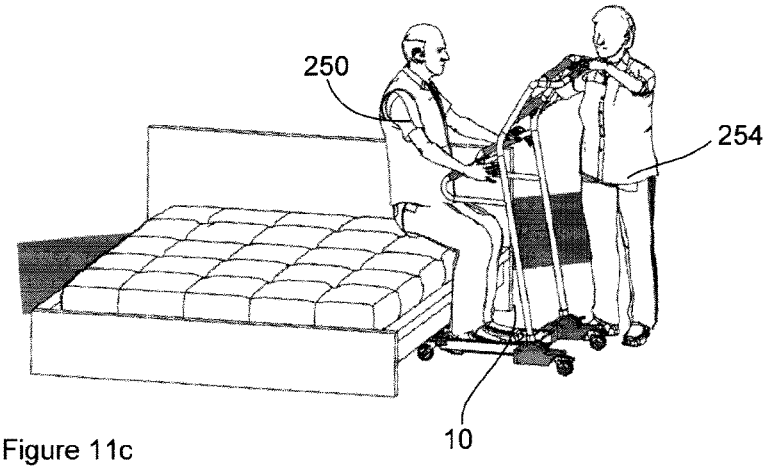
Figure 12:
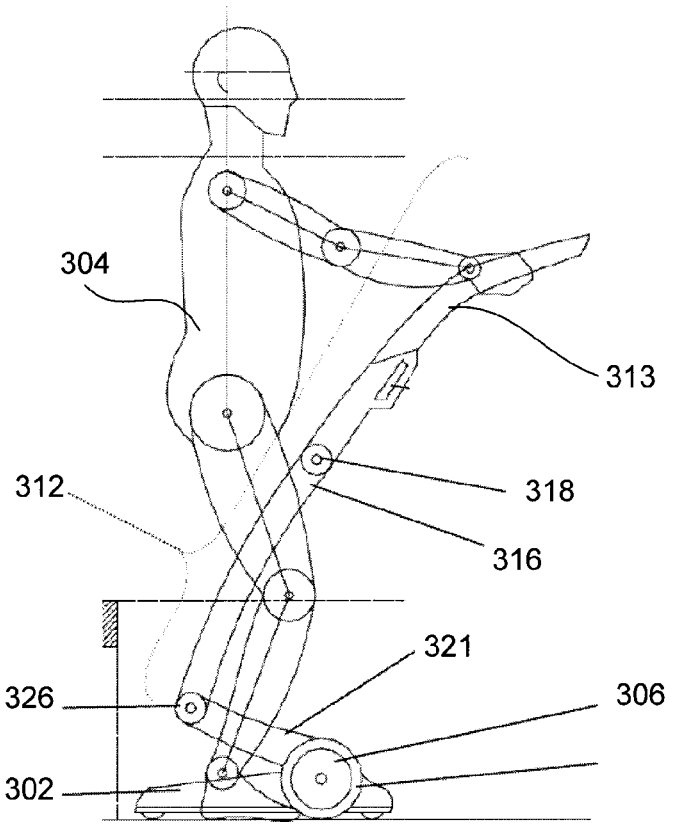
FIG. 12 shows views an assistive device, in another exemplary embodiment.

FIGS. 11*a* to 11*c* show the assistive device 10 in use for transferring patient 250 from an initial standing position to a sitting position, by operator 252. Once patient 250 is brought to the desired location, operator 252 unlock locking mechanism and gently guide the patient 250 and lower the frame assembly 14 back to its loading position. Accordingly, device 10 allows an operator or caregiver 252 to lift and transfer patient within a given setting, such as a home environment, hospital or assisted-living facility. For example, operator 252 may operate device 10 to lift, move or transfer patient 250 that needs assistance, e.g. from a bed to a wheelchair or walker, or from a wheelchair to a walker, toilet, or any other transfer situation.

In another embodiment, each of pair of oppositely disposed, elongated tubular members 40, 41 is telescoping for length adjustment to suit the height of patient 250 and/or caregiver 252.

In another embodiment, each of two tubular members 32, 33 are telescoping to permit height adjustment of device 10 to suit patient 250 and/or caregiver 252.

In another embodiment, each of arcuate segment 42, 43 are telescoping to permit height adjustment of device 10 to suit patient 250 and/or caregiver 252.

In another embodiment, castor wheels 30, 31 include a braking system.

In another embodiment, platform 22 is releasably removable from platform chassis portion 20, thereby enabling ambulatory motion by patient 250 using device 10.

In another embodiment, platform chassis portion 20 is releasably removable from transverse tubular member 25.

In another embodiment, there is provided an auxiliary supporting system for a patient, such as a belt strap placed behind a patient's torso and having one end releasably attached to elongated tubular member 40, and another end releasably attached to elongated tubular member 41. The auxiliary supporting system may include a plurality of belts or bands for supporting the waist, hips and upper part of the legs of the patient. The belt or band impedes patient 250 from falling backwards when rising from a seated position or descending into a seated position. The belt or band may be adjustable to suit various body shapes and sizes. The auxiliary support system may further comprise opposed swivable and lockable side supports 260, 262 which provide side support to patient 250. Side supports 260, 262 substantially prevent patient 250 from falling to either side, and may be used as handles on which patient 250 pushes on in order to walk with device 10, when platform 22 is removed.

In another embodiment, platform chassis portion 20 comprises a counterweight to provide additional stability to device 10, and hence patient 250 during raising and standing.

In another exemplary embodiment, device 10 includes members formed of aluminum, steel or plastic.

In yet another exemplary embodiment, a portable transfer and lifting device 300 is employed for moving a patient 304 from a seated position to a standing position to facilitate standing from a bed or toilet, as well as transfer from a sitting device (e.g., wheel chair) to another sitting device or ambulatory assistive device. Referring generally to FIGS. 12 and 16*a* to 16*d*, device 300 comprises a base 302 upon which patient 304 places their feet while in a sitting position, said base 302 including lockable wheels 306 wherein wheels 306 are locked during transfer and when unlocked they allow for wheeled movement of device 300. In one embodiment, a central and/or common locking/unlocking mechanism is used to secure wheels 306 so that both wheels 306 are either in a locked or unlocked state. When used for lifting a patient 304 to a standing position wheels 306 are locked, and then unlocked when device 300 needs to be moved.

Figure 16A:
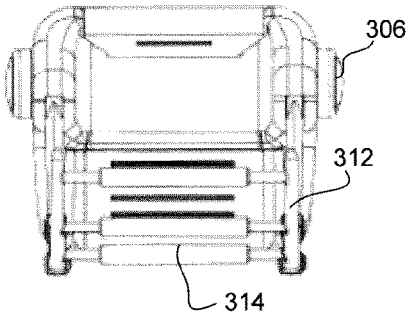
FIGS. 16*a* to 16*d*, and 17*a* to 17*e* are exemplary views of the device in various configurations for use and storage.
Figure 16B:
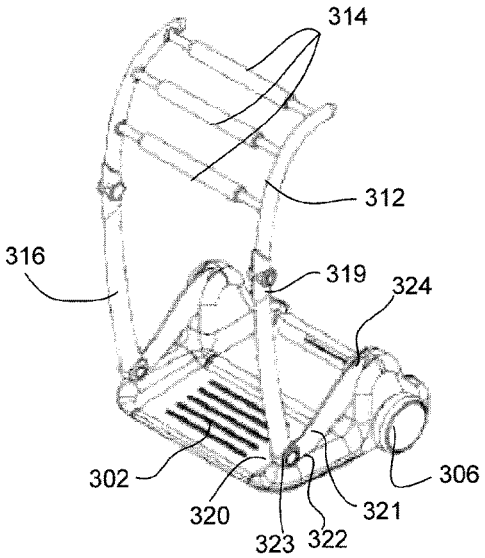
Figure 16C:
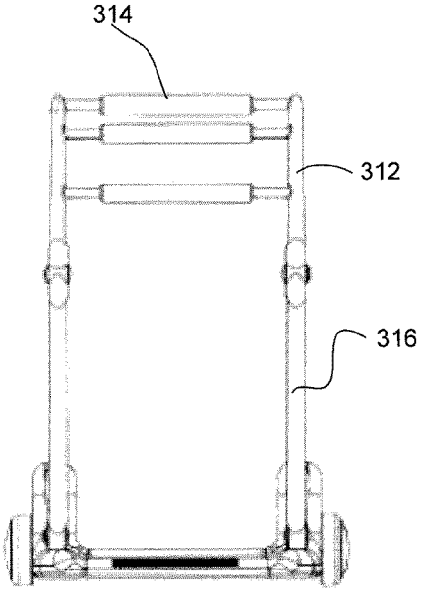
Figure 16D:
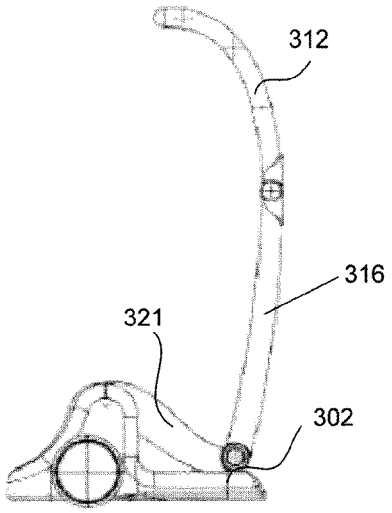
Figure 17A:
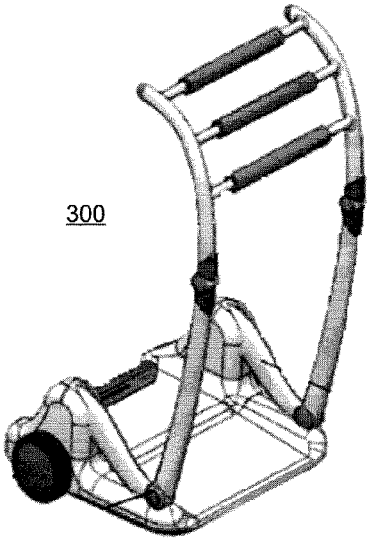
Figure 17B:
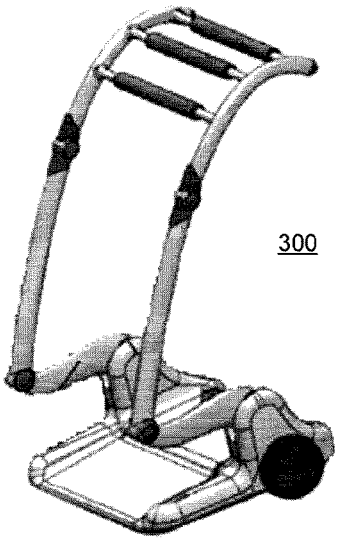
Figure 17C:
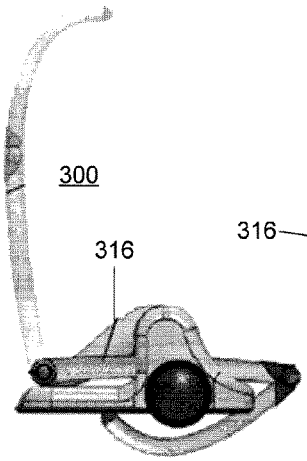
Figure 17D:
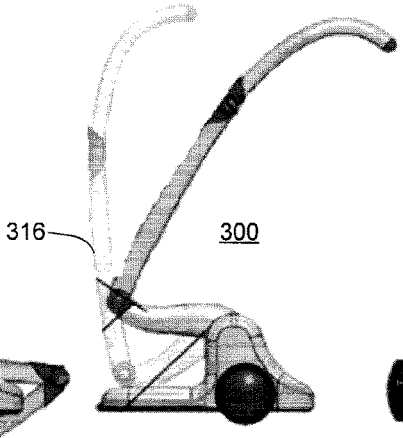
Figure 17E:
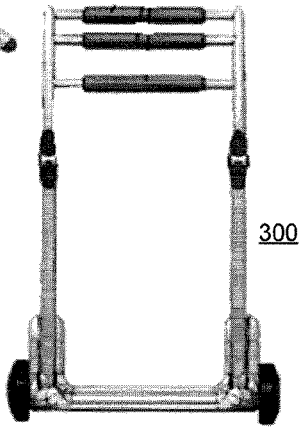

Pivotally attached to base 302 at pivot location 310 is a curved handle assembly 312. Handle assembly 312 includes a top section 313 with a plurality of handles 314, curved upper arms 316 pivotally attached to top section via folding and lockable joint 318 at one end 319, and other end 320 attached to lower arms 321 at one end 322 of lower arms 321 via folding and lockable joint 323, and each second end 324 of pair of lower arms 321 is pivotally attached to base 302. As illustrated, handle assembly 312 also has a plurality of handles 314 extending between curved upper arms 316. Handles 314 may further include padding, grips or similar devices spaced along or between upper arms 316. Curved upper arms 316 may also be folded at joint 318. As illustrated in FIGS. 16*a* and 17*c*, arms 316 may be folded so that they rest largely within or adjacent base 302 so that device 300 can be collapsed and stored in a small space. Furthermore, as depicted in 16*a* and 17*c*, folding handle assembly 312 folds in a top-down manner, such that when folded, lower arms 321 and curved upper arms 316 are in proximity to base 302 to make device 300 compact and suitable for storage.

Figure 13:
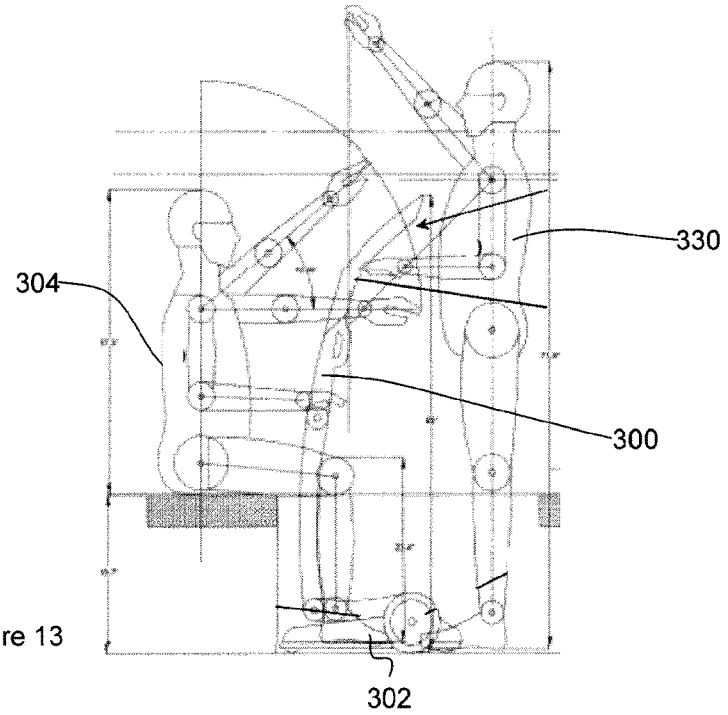
FIGS. 13 and 14 show side views illustrating use of the device of FIG. 12 while moving a patient from a sitting position towards a standing position.
Figure 14:
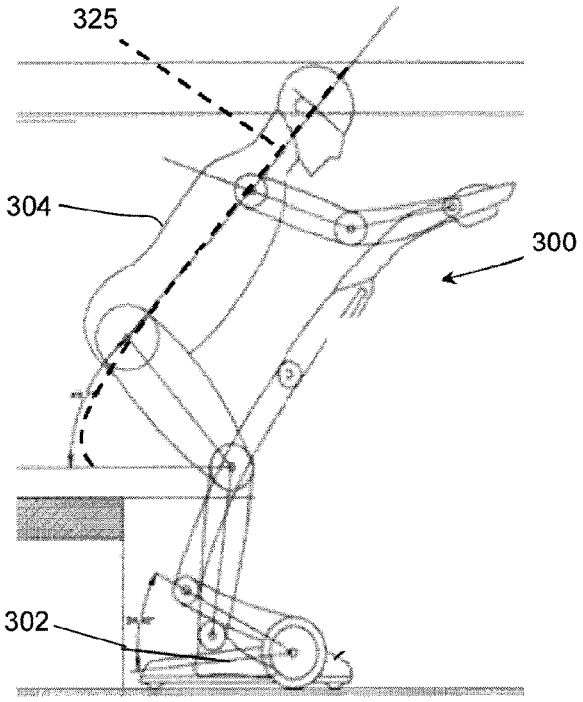

In use, top section 313 curved away from patient 304 so that generally one of handles 314 is at a position suitable for grasping by patient 304 with their arms both fully extended and angled or raised upward, as shown in FIG. 13, whereas another handle 314 is suitable for being grasped by caregiver 330, and wherein when grasped by both patient 304 and caregiver 330, and caregiver 330 pulls on second handle 314, patient 304 is pulled from the seated position towards the standing position, lifting patient 304 along an upward arc 325 (e.g., arc 325 travels from the seat or chair toward a ceiling).

Device 300 may further include a belt, strap, harness or similar means for supporting patient 304 while they are lifted. The harness would attach to handle assembly 312 to prevent patient 304 from falling backwards or returning to the sitting position once raised. Having generally described the major components of the device 300. In order for caregiver 330 to pull patient 304 from a seated position patient 304 initially holds on to device 300 (e.g., handle 314) while seated with both arms extended. This allows the whole body to move in the direction of caregiver 330 as shown by FIG. 13, since if the arms are bent then the only body parts that will move during the initial pull by caregiver 330 will be the hands and arms of patient 304 and only when the arms are fully extended will the body move. In order to have the arms extended at all times as well as minimizing the distance between the patient, caregiver 330 and the device 300, the pivot point is placed behind handles 314 while handles 314 are curved up and extended forward. Advantageously, device 300 can be placed in close proximity with the patient 304 for small or tight environments such as small bathrooms while still requiring the patient 304 to extend their arms to grab the handles 314.

Figure 15A:
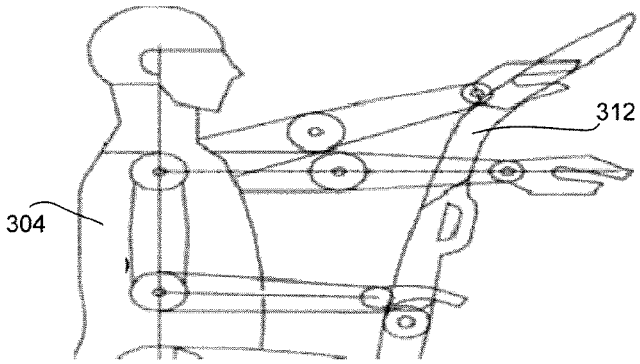
FIGS. 15*a* to 15*d* are illustrative examples of positioning of the patient relative to use of the device.

With regard to the positioning of the hands, in order to accommodate patients 304 of different heights the top section 313 of the handle assembly 312 is curved away from patient 304 such that patient 304 can grasp one of the handles 314 suitable to them, as shown in FIG. 15*a*.

Figure 15B:
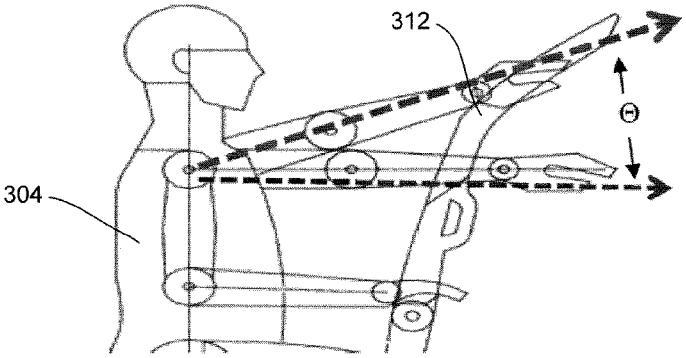

In order to improve the posture of the patient 304 while being lifted, the arms are at a 20 to 30 degree angle theta (Θ) as shown by FIG. 15*b*. This allows the body travels at an upward arc 325 instead of merely bending at the center of the body, as the horizontal arms will only cause the body to bend at the center and be pulled horizontally. Creating an upward angle with arms relative to the center of the body allows the device 300 to be used to pull the patient 304 upward. The overall height of the product, approximately 55 inches, and various handle locations is designed to facilitate the upward position of the patient's arms for a range of patient 304 body sizes.

Figure 15C:
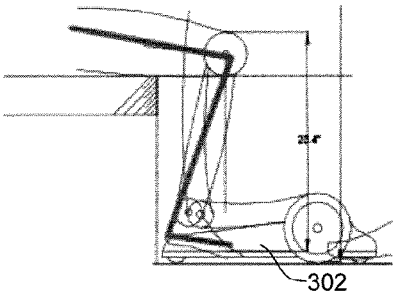
Figure 15D:
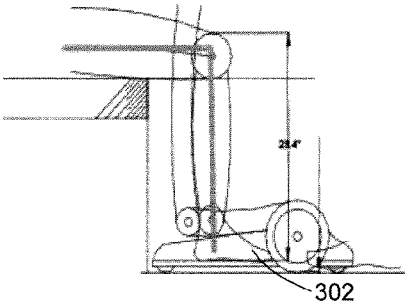

During the lifting process the patient 304 is seated upward at about 90 degrees while the feet (ankles) are also at a 90 degree angle relative to base platform 302. FIG. 15*c* shows an undesirable position relative to device 300, while FIG. 15*d* shows a desired position relative to device 300.

In order to improve the posture of patient 304 the device 300 is designed to lift patient 304 at an upward arc 325. The arc 325 is created by the central pivot or lever indicates the direction that patient 304 will travel. By extending the bar away from the pivot point the initial arc 325 is upward instead downward, since if caregiver 330 starts to pull the patient 304 at a downward arc 325 then the body of patient 304 would only bend and not move.

While the description above relating to the lifting, standing, and sitting process is directed towards device 300, the same description is applicable to device 10.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "comprises," "comprising," or any other variations thereof, are intended to cover a non-exclusive inclusion, such that a process, method, article, or device that comprises a list of elements does not include only those elements but may include other elements not expressly listed or inherent to such process, method, article, or device. Further, no element described herein is required for the practice of the invention unless expressly described as "essential" or "critical."

The preceding detailed description of exemplary embodiments of the invention makes reference to the accompanying drawings, which show the exemplary embodiment by way of illustration. While these exemplary embodiments are described in sufficient detail to enable those skilled in the art to practice the invention, it should be understood that other embodiments may be realized and that logical and mechanical changes may be made without departing from the spirit and scope of the invention. For example, the steps recited in any of the method or process claims may be executed in any order and are not limited to the order presented. Further, the present invention may be practiced using one or more servers, as necessary. Thus, the preceding detailed description is presented for purposes of illustration only and not of limitation, and the scope of the invention is defined by the preceding description, and with respect to the attached claims.

The invention claimed is:

1. An assistive device comprising:

a chassis;

a handle assembly pivotally attached to said chassis, said chassis comprising a handle chassis portion for receiving a handle assembly and a platform chassis portion extending from handle chassis portion with a standing platform; wherein said handle assembly includes a pair of oppositely disposed, elongated tubular members, wherein a first end of each of said pair of oppositely disposed, elongated tubular members comprises an arcuate segment, and a primary transverse tubular handlebar grip secured between said first ends;

a locking mechanism operable to place said handle assembly into a plurality of positions, and maintain said handle assembly in one of said plurality of positions;

wherein a second end of each of said pair of oppositely disposed, elongated tubular members is coupled to said locking mechanism;

a lever mechanism coupled to said locking mechanism to actuate said locking mechanism; and wherein said plurality of positions correspond to one of a loading position, an upright position and a storage position.

2. The assistive device of claim 1, wherein each of said tubular members are perpendicularly disposed to said crossbar tubular member wherein each of one end of said first pair of oppositely tubular members comprised at least one lockable wheel.

3. The assistive device of claim 2, wherein said platform chassis portion is formed of a second pair of two oppositely disposed tubular members extending perpendicularly from said crossbar tubular member at one end of each of said second pair of two oppositely disposed tubular members; wherein each of other end of said first pair of oppositely tubular members comprises at least one lockable wheel.

4. The assistive device of claim 3, wherein a plurality of secondary transverse tubular primary handlebar grips are secured between said arcuate segments.

5. The assistive device of claim 4, wherein said locking mechanism comprises a handle bracket having a tubular body with a bore to receive other ends of said elongated tubular members.

6. The assistive device of claim 5, wherein said handle bracket is pivotally attached to said crossbar tubular member.

7. The assistive device of claim 6, wherein said said handle bracket comprises a loading position aperture, an upright position aperture, a storage position aperture.

8. The assistive device of claim 7, wherein said locking mechanism comprises a mode pin actuatable by said lever mechanism to interchangebly place said mode pin in at least one of said loading position aperture, upright position aperture and storage position aperture; and to maintain said mode pin in said at least one of said loading position, upright position and storage position.

9. The assistive device of claim 8, wherein said device is used to move a patient from a seated position to a standing position, and from said standing position to said seated position.

10. The assistive device of claim 9, wherein said patient is pulled from said seated position to said standing position by lifting said patient along a predetermined upward arc; and wherein said patient is urged from said standing position to said seated position along a predetermined downward arc.

11. The assistive device of claim 9, wherein said standing platform is detachably removed to allow a patient to use said device as a walking aid.

12. The assistive device of claim 8, herein said device comprises an auxiliary supporting system for said patient.

13. The assistive device of claim 12, wherein said auxiliary supporting system includes at least one of a belt and a band placed behind said patient having one end releasably attached to one of said elongated tubular members, and another end releasably attached to another end of said elongated tubular members; wherein said at least one belt and band is placed behind said patient to support at least one of patient's torso, waist, hips and upper part of the legs; and wherein said at least one belt and band is adjustable.

14. The assistive device of claim 9, wherein auxiliary supporting system further comprises opposed swivable and lockable side arms on each of said pair of oppositely disposed, elongated tubular members to substantially prevent said patient from falling to either side, and to be used as handles on which said patient pushes on in order to walk with said device, when said platform is removed.

15. A transfer and lifting device for moving a person from a seated position to a standing position, comprising:

a base upon which said person places their feet while in a sitting position, said base including lockable wheels wherein said wheels are locked during transfer and when unlocked they allow for wheeled movement of said device; and a handle assembly pivotally attached to said base, said handle assembly comprising a curved portion including a plurality of handle bars on an assembly that is curved away from said such that at least one of said plurality of handle bars is suitable for grasping by said person with their arms fully extended and raised upward and at least another of said plurality of handle bars is suitable for being grasped by an aide, wherein when grasped by both said person and said aide and said aide pulls on at least one of said plurality of handle bars, said person is pulled from the seated position to the standing position, lifting said patient along an upward arc; and wherein said wheels are locked by actuation of a central locking mechanism.

16. The device of claim 15, further comprising an auxiliary supporting system for supporting said person, wherein auxiliary supporting system comprises at least one of a belt and/or a band placed behind said person having at least one end releasably attached to said handle assembly, and a pair of opposed swivable and lockable arms on said handle assembly to substantially prevent said person from falling to either side, and to be used as handles on which said person pushes on in order to walk with said device, when said platform is removed.

17. The device of claim 15, wherein said device is used for moving said person from said standing position to said seated position wherein and said aide pushes on at least one of said plurality of handles, said person is pushed from said standing position to said seated position along a downward arc.

18. The assistive device of claim 15, wherein wherein said locking mechanism comprises a mode pin actuatable by said lever mechanism to interchangebly place said mode pin in at least one of said loading position aperture, upright position aperture and storage position aperture; and to maintain said mode pin in said at least one of said loading position, upright position.

19. A method of transferring a patient from a seated position to a standing position, the method having the steps of:

providing an assistive device having:

a chassis;

a handle assembly pivotally attached to said chassis, said chassis comprising a handle chassis portion for receiving a handle assembly and a platform chassis portion extending from handle chassis portion with a standing platform;

a locking mechanism operable to place said handle assembly into a plurality of positions, and maintain said handle assembly in one of said plurality of positions;

a lever mechanism coupled to said locking mechanism to actuate said locking mechanism; and wherein said plurality of positions correspond to one of a loading position, an upright position and a storage position;

positioning said patient in front of said device to grasp said handle assembly while seated; and pulling said patient from said seated position to said standing position by pulling on said handle assembly to lift said patient along a predetermined upward arc.

20. The method of claim 19, wherein said patient is transferred urged from said standing position to said seated position by, positioning said patient in front of said device to grasp said handle assembly while standing; and urging said patient from standing position to said seated position by pushing on said handle assembly to cause said patient to descend along a predetermined downward arc.

* * * * *